US006729558B1

(12) United States Patent
Seenauth

(10) Patent No.: US 6,729,558 B1
(45) Date of Patent: May 4, 2004

(54) GRANULAR FERTILIZER SPREADER

(75) Inventor: Harold Seenauth, 13606 River Forest Dr., Ft. Myers, FL (US) 33905

(73) Assignee: Harold Seenauth, Ft. Myers, FL (US)

( * ) Notice: Subject to any disclaimer, the term of this patent is extended or adjusted under 35 U.S.C. 154(b) by 0 days.

(21) Appl. No.: 10/377,546

(22) Filed: Mar. 3, 2003

(51) Int. Cl.[7] ..... B05B 9/08

(52) U.S. Cl. ..... 239/152; 239/153; 239/375; 239/376; 239/379; 239/652; 239/653

(58) Field of Search ..... 239/152, 153, 239/375, 376, 378, 379, 652, 653

(56) References Cited

U.S. PATENT DOCUMENTS 5,339,994 A * 8/1994 Nuila ..... 222/175
5,503,090 A * 4/1996 Guzan ..... 111/7.2
6,089,477 A * 7/2000 Dillon ..... 239/153
6,575,695 B1 * 6/2003 Miyamoto ..... 239/154
2002/0175222 A1 * 11/2002 Vaage ..... 239/153

* cited by examiner

*Primary Examiner*—Robin O. Evans

(57) ABSTRACT

The invention is directed to a granular spreader device that includes a tear-shaped container having a lower rotary outlet The granular material feeds downwardly by gravity into a flexibly tube through a rotary fitting. From there the granular material feeds into a hand held rigid tube and from there into a distributor head similar to a shower head. At the juncture between the flexible tube and the rigid tube there is a manually operated shutoff valve. The container has shoulder straps for carrying the container on the back of a person or a separate carrier has the container separately attached to the same. A simple agitator operates a wire system inside the container to disintegrate any clumps that may formed within the granular material inside the container because of moisture.

4 Claims, 4 Drawing Sheets

GRANULAR FERTILIZER SPREADER

BACKGROUND OF THE INVENTION

The invention involves a spreader for granular fertilizer material. Such spreaders are well known in the form of hoppers that spread a wide swath of material on the ground to cover quite a large area. The hoppers are adjustable as to how much of the material should be spread at any one time. At times, fertilizer material has to be reapplied but only in certain areas that were missed or close to bushes or flower edges that were inaccessible to the spreader in the first place. Many times, the reapplication results in a double application of the granular material. such double application results in over fertilization and waste of material.

Another spreader device is known that is carried on the chest of the person doing the spreading and the spreading itself is carried out by a hand crank that operates a spreader disk which slings the fertilizer material forward of the person in a circle. It is quite possible that the person walks right into the circle thereby soiling the clothing. Another problem with this device is that it is difficult to adjust or control the amount of the fertilizer to be spread unless the rotating crank is turning at different rotational speeds.

A third type of spreading device is carried on the back of the person but until now could only be used for liquid materials and a hand carried applicator does the spreading. These deices are mostly used to spread materials that either subdue or eliminate lawn parasites. This type of spreader device can only be operated by pressurizing the content in the container.

BRIEF SUMMARY AND OBJECTS OF THE INVENTION

In view of all of the above, applicant has converted the liquid spreader that is carried on the back of a person to a spreader device that is able to spread granular material by way of gravity. The granular material is carried in a container on the back of a person. The container is somewhat funnel or tear shaped so that the granular material can slowly sink down in the container as the material is dispensed. Although not necessary, a simple agitator is installed in the bottom of the container just in case that the material forms clumps because of moisture. At the bottom there is a flexible hose which is connected to a rigid hand held tube. The tube has a valve therein to control the flow of the material. At the bottom of the hand held tube there is a head having holes therein similar to a shower head. The head can be directed to where the material is needed such as under bushes and inaccessible areas. This arrangement allows the person to apply material in areas missed before without duplication of material or on concrete structures that tend to be discolored because of the characteristics of the material.

DETAILED DESCRIPTION OF THE INVENTION

Figure 1:
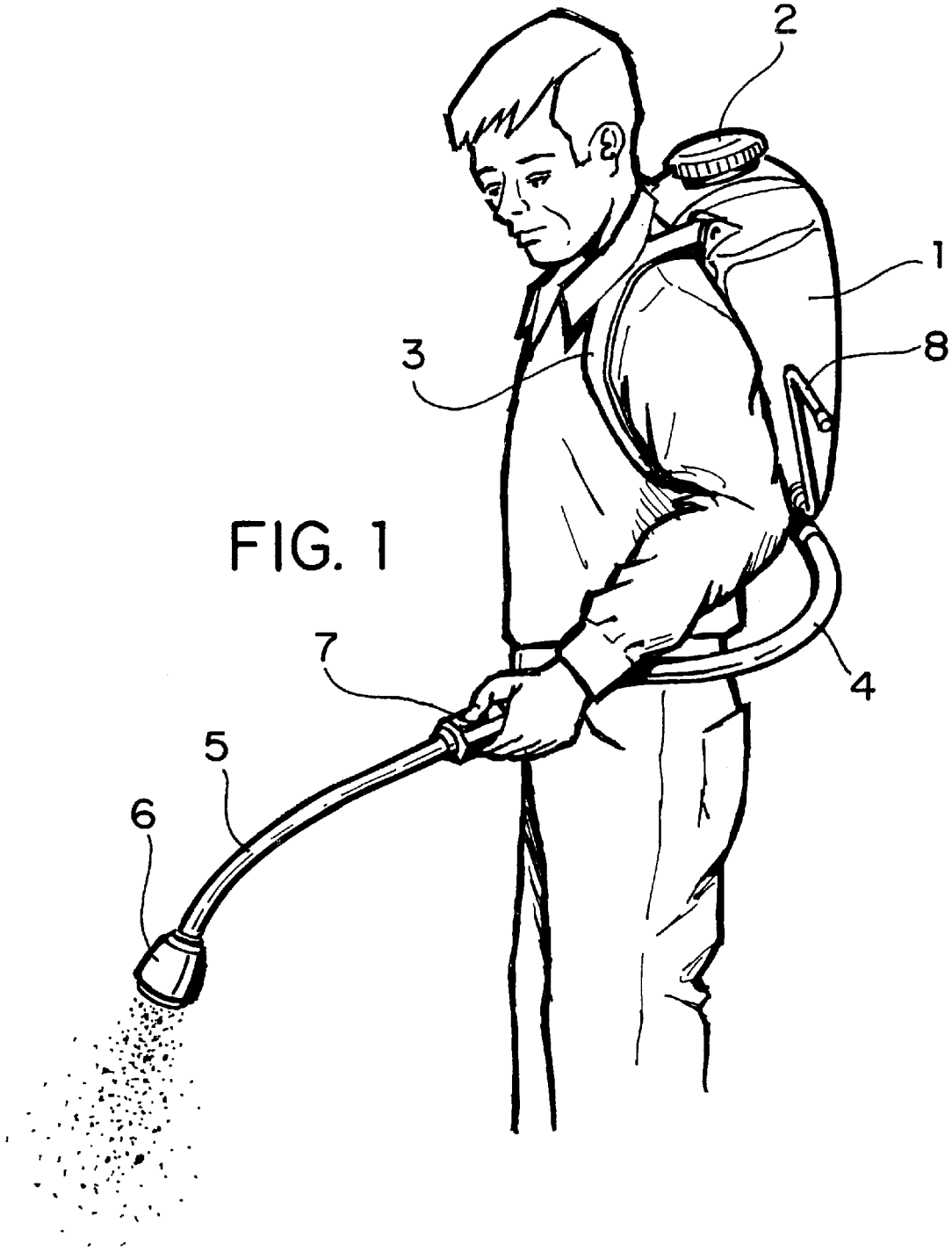
FIG. 1 shows a perspective view of the spreading device in use.

FIG. 1 illustrates how the device is being used. The canister or container 1 is being worn on the back of a person by the shoulder straps 3 attached to the container. The container has a closure or filler cap 3. Since the material in the container is feeding by gravity, the container is somewhat tear shaped so that all of the material will sink to the bottom and to the center thereof. This shape will be shown in later FIGURES. From the bottom center of the container a flexible hose 4 will continue downwardly to the vicinity of the hand of the user and from there it will continue into a rigid tube 5. The front of the rigid tube 5 has attached thereto a distributor head which may be compared to a shower head. Of course, the multiple of openings in the distributor head are such so as to accommodate the largest granular particle of the granular material. At the transition from the flexible tube 4 to the rigid tube 5 there is located a shut-off valve 7 so that the flow of the granular material can be stopped or started at any time. At times it is quite possible that the granular material may clump together because of moisture, the container has an agitator therein which is a convoluted wire which, when activated, disintegrates the clumps for an easy flow of the granular material. The lever 8 will activate the disintegrator inside the container when it is pushed by an elbow of the user.

Figure 2:
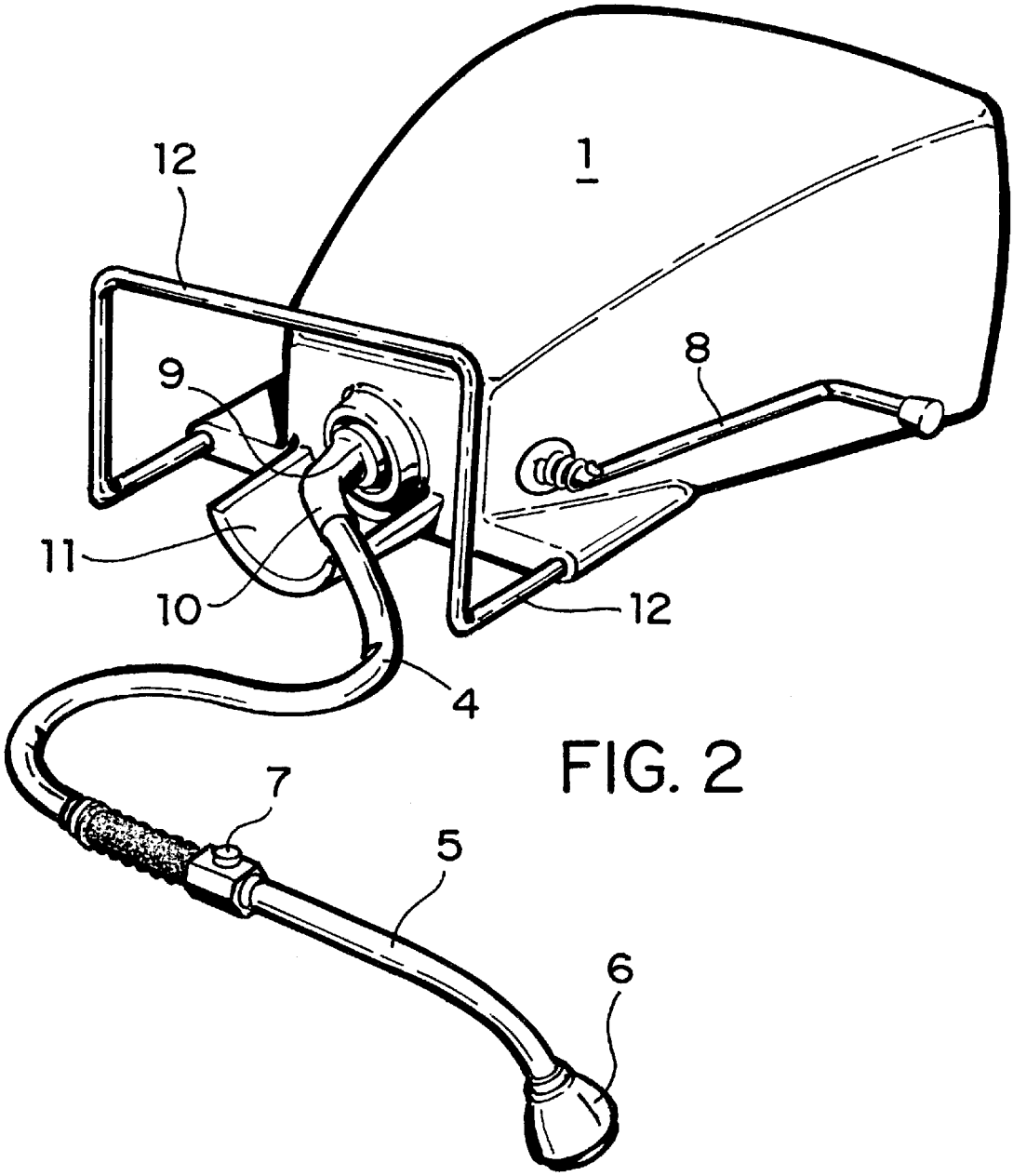
FIG. 2 shows the spreading device in a rest position lying on its back.

FIG. 2 shows the container 1 on its back. The same reference characters have been used as in the previous FIGURE. In this view one can see the agitator arm 8 including a return coil spring 15. The coil spring 15 is important because once the arm 8 has been pushed back by the elbow of a user, it must return to its original position. Also shown in this FIGURE is a rotatable fitting 9 which will allow the flexible hose 4 to be rotated into different positions by way of a rigid elbow 10. The rotation of the rigid elbow is limited through the use of a rotation limiter 11 which is a rigid extension of the bottom of the container. Also shown in FIG. 2 is a frame 12 which is attached to the container 1 in such manner so that the container can be set and maintained in an upright position.

Figure 3:
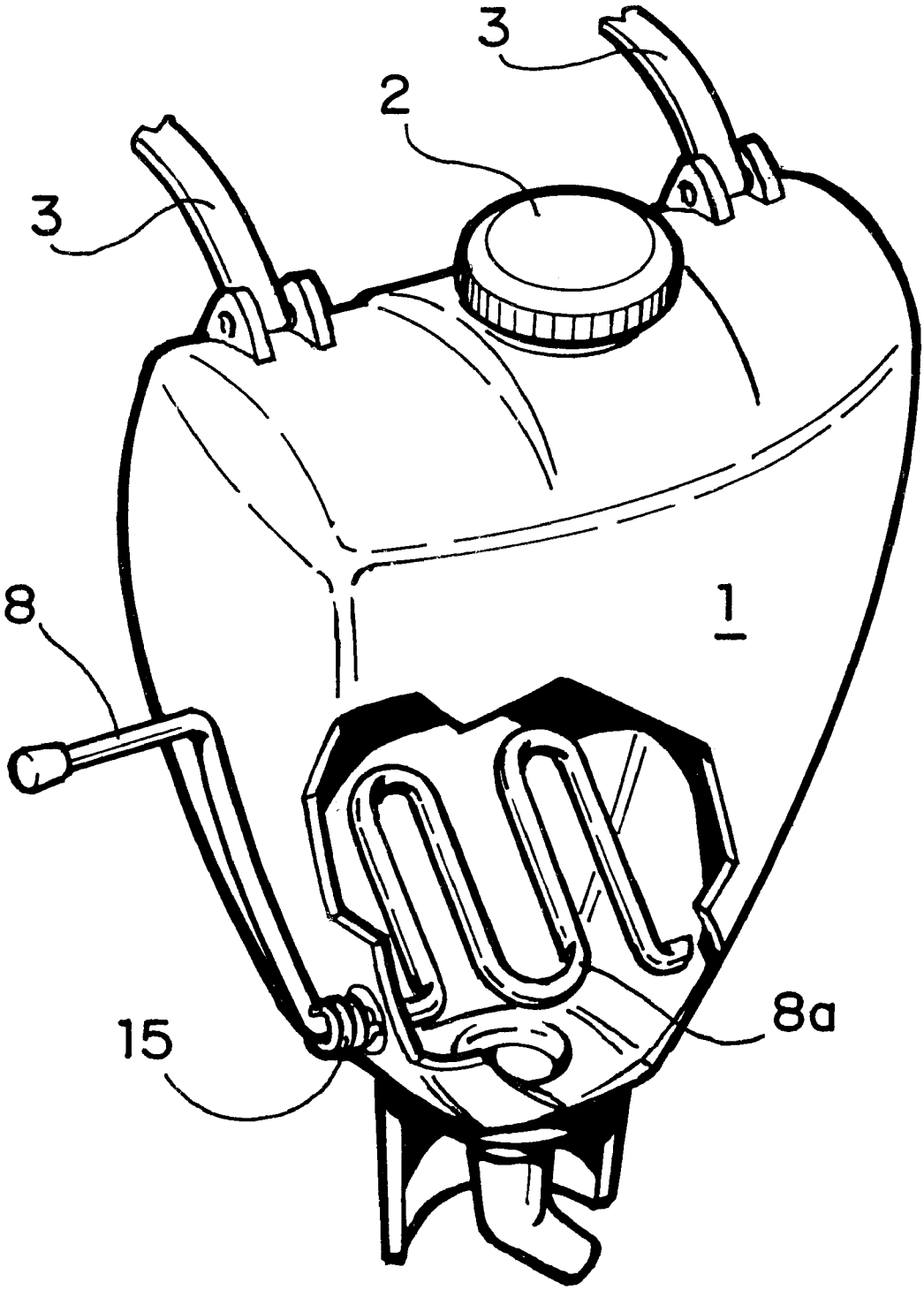
FIG. 3 shows the container of the spreading device partially broken away.

FIG. 3 illustrates the same container of FIGS. 1 and 2 but this FIGURE shows a part of the interior of the container showing the convoluted wire 8*a* to aid in the disintegration of clumped granular material.

Figures 4, 5:
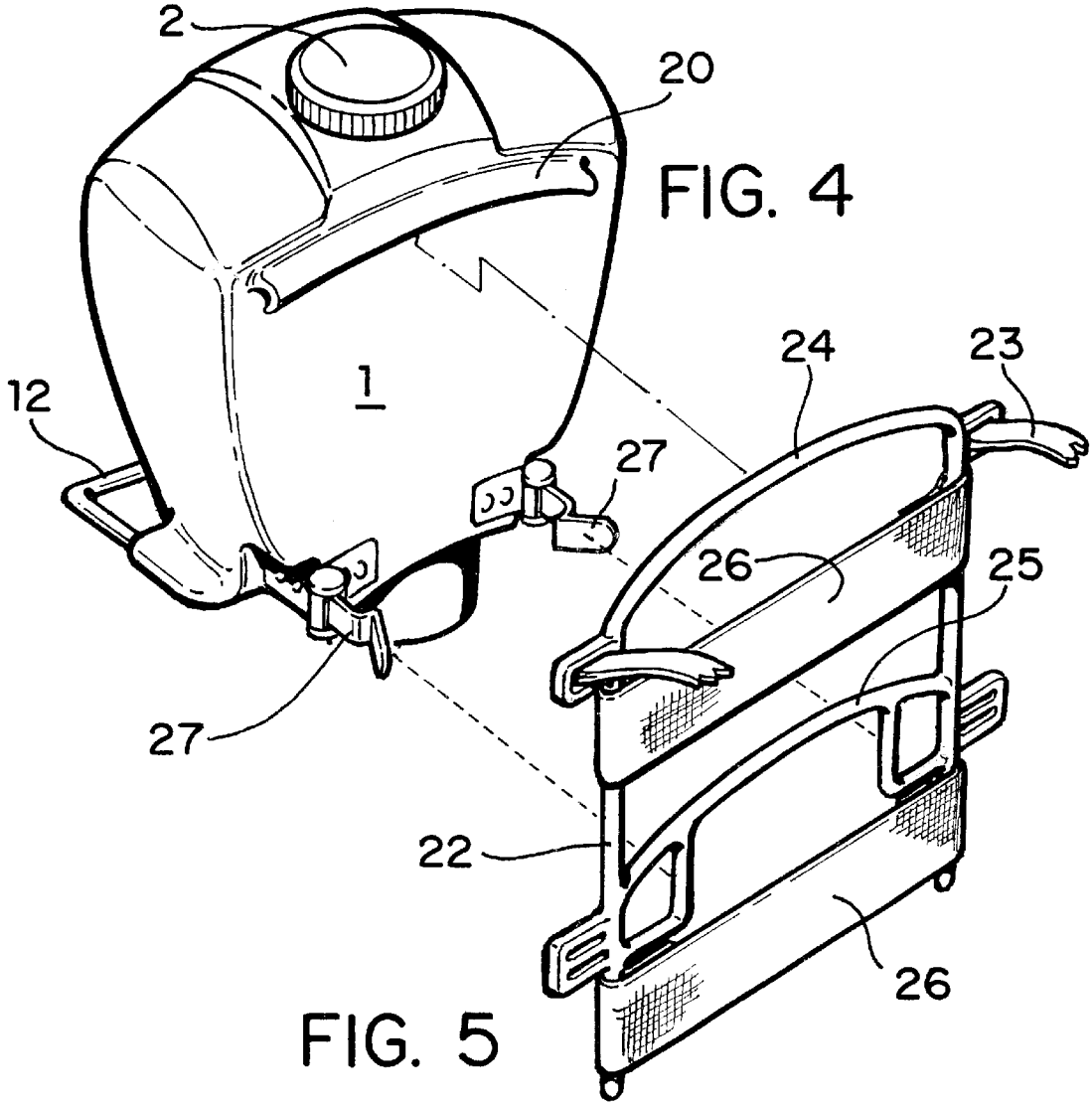
FIG. 4 shows the container with a carrier attaching device thereon.
FIG. 5 shows an implement for carrying the container on the back of a person

FIG. 4 has no shoulder straps at all but shows a convoluted and curved hook assembly 20 on the back of the container. This convoluted hook assembly may be molded into or onto the container when it is manufactured or it may be added at a later date by an adhesive process.

FIG. 5 shows a back carrier adapted to carry the granular material container. To this end there are shown the shoulder 23. The carrier consist of a U-shaped frame 22 having canvass straps 26 across the frame to aid in conforming to the contour of the back of the wearer. At the top of the frame 22 there is placed a forwardly extending bow type tube 24 which conforms to the shape of the hook shape 20 that is attached to or part of the container 1. When the container with its hook 20 is placed over and onto the bow type tube, it will securely lock into place. In order to secure the lower end of the container to the carrier frame, there are snaps 27 provided on the carrier that will snap onto lateral extensions on the back carrier.

Conclusion

It should be pointed out that the inventive concept does not only apply to a device for spreading fertilizer but is far more versatile in that the device can spread quite an array of granular materials. This includes herbecides known as weed killers and fungicides. It has also been found that the spreading device of the inention is extremely effective i4 n spreading salt compounds on icy and snow-impacted walk ways or sidewalks. The hand held spreader can easily be directed and the granular material be deposited in areas were it is most needed without wasting any material.

What I claim is:

1. A granular material spreader comprising a pear shaped container having granular material therein, said granular material is adapted to feed to the bottom of said container by gravity, a rotary outlet fitting receives said material by gravity and delivers said material to a flexible hose connected thereto, from there said material is fed to a rigid tube having a distribution head at its end, a stop material valve is connected between said flexible tube and said rigid tube, said granular spreader including a separate carrier on a back of a person, said container having means thereon for fastening said container to said separate carrier including an elongated hook on said container and an elongated bow on said carrier, said elongated hook on said carrier will fit over said bow when engaged with each other.

2. The granular material spreader of claim 1, including shoulder straps attached to said carrier, to carry said container on a back of a person.

3. The granular material spreader of claim 1 including an agitator inside said container for loosening clumps of said material when present inside said container.

4. The granular material spreader of claim 3, wherein said agitator has an activator outside of said container including a return spring so that said agitator can be activated repeatedly.

* * * * *